United States Patent [19]

Skogward

[11] Patent Number: 4,729,330

[45] Date of Patent: Mar. 8, 1988

[54] SPEED CONTROL SYSTEM FOR A SEWING MACHINE

[75] Inventor: Kenneth O. E. Skogward, Huskvarna, Sweden

[73] Assignee: Husqvarna Aktiebolag, Sweden

[21] Appl. No.: 22,129

[22] Filed: Mar. 5, 1987

[30] Foreign Application Priority Data

Mar. 11, 1986 [SE] Sweden ..... 8601130

[51] Int. Cl.[4] ..... D05B 69/18; D05B 27/22

[52] U.S. Cl. ..... 112/315; 112/277

[58] Field of Search ..... 112/277, 275, 453, 456, 112/220, 121.11, 315, 121.12; 318/305, 342, 348

[56] References Cited

U.S. PATENT DOCUMENTS 4,108,093 8/1978 Watanabe et al. ..... 112/453 X 4,164,192 8/1979 Herr et al. ..... 112/453

*Primary Examiner*—Peter Nerbun

*Attorney, Agent, or Firm*—Alfred E. Miller

[57] ABSTRACT

In a speed control arrangement for a sewing machine, a control is provided for setting a comfortable cloth feeding speed, and the speed control arrangement controls the speed of the sewing machine motor directly as a function of the set cloth feed and inversely as a function of the seam length.

4 Claims, 2 Drawing Figures

SPEED CONTROL SYSTEM FOR A SEWING MACHINE

The present invention relates to a sewing speed control arrangement for a sewing machine with setting means for r.p.m. and stitch length.

In sewing machines with a simple control of stitch length and r.p.m. it is possible for the operator to set maximum values on these controls, and then find that the cloth feeding speed on the stitch plate will be unconveniently high, making it difficult to guide the working material forward with a desirable accuracy. By setting a large stitch length the operator must then control the r.p.m. by the foot control so that a comfortable cloth feeding speed can be achieved. However, it may be difficult to adjust and keep an optimal r.p.m. by means of the foot control at several stitch lengths. In electronic sewing machines feeding is effected by means of a stepping motor which requires special solutions of the problem to keep a limited, predetermined feeding speed.

The problem has been solved by the invention from a new point of view which involves a presetting of a comfortable cloth feeding speed and after that limiting of the maximum r.p.m. of the sewing machine so that the predetermined speed of the cloth is not exceeded at a full adjustment of the speed control of the sewing machine. In this new point of view the maximum r.p.m. (r) of the sewing machine is a function of the cloth feeding speed (v) and the stitch length (s) according to the formula $$r = v/s$$

Since the speed of the cloth v is limited and predetermined (a constant), the maximum r.p.m. will thus decrease at an increase of the stitch length s.

A couple of embodiments according to the invention will be described in the following paragraphs with reference to the accompanying drawing which shows in FIG. 1 a stitch length control mechanically connected to a current control, FIG. 2 several controls connected to a computer with control means for driving a motor.

Figure 1:
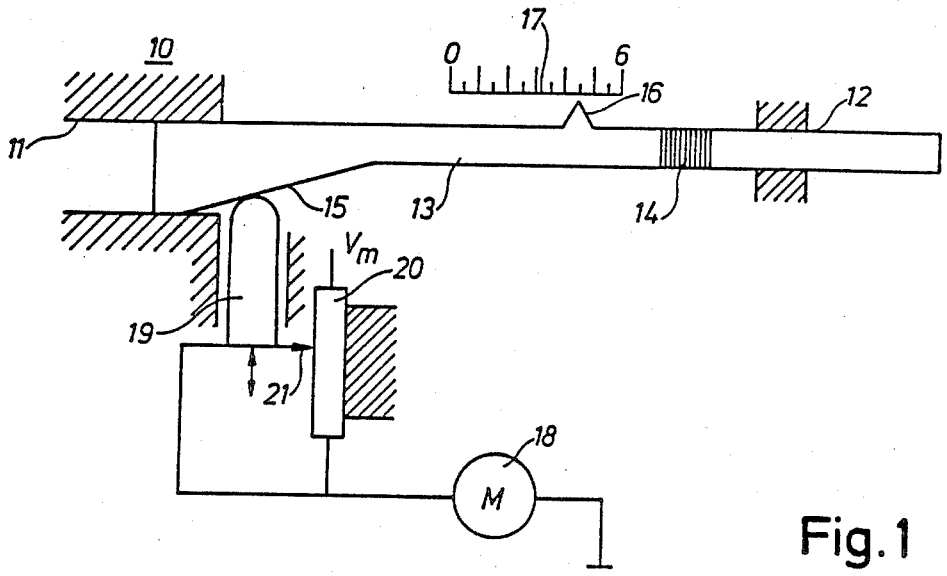

The stitch length control is schematically showin in FIG. 1 in a part of a sewing machine body 10 with bearings 11, 12 guiding a rod 13 with a finger grip 14 and an inclined guiding surface 15. The rod can be displaced in longitudinal direction, whereby a dial 16 on the rod points to a scale 17 on the body showing the stitch length at the adjusted position. The adjustment (displacement) is transferred by movement transferring means to a guide (not shown) by which several feeding lengths of the feeder are adjusted. The current control of the driving motor 18 is here positioned in close connection to the guiding surface 15, and a pin 19 is in engagement with the surface during certain positions of the stitch length control. The current to the motor is adjusted by a variable resistor 20, the r.p.m. of the motor increasing when a movable contact 21 is moved upwards on the resistor. The pin and the contact are joined to follow one another up and down on the resistor. When the pin abuts the surface 15, the contact can move no further upwards on the resistor and the r.p.m. cannot even be further increased. Thus, the device serves as an r.p.m. limiter, whereby the restriction of r.p.m. is greater the longer the stitch length the machine carries out.

Figure 2:
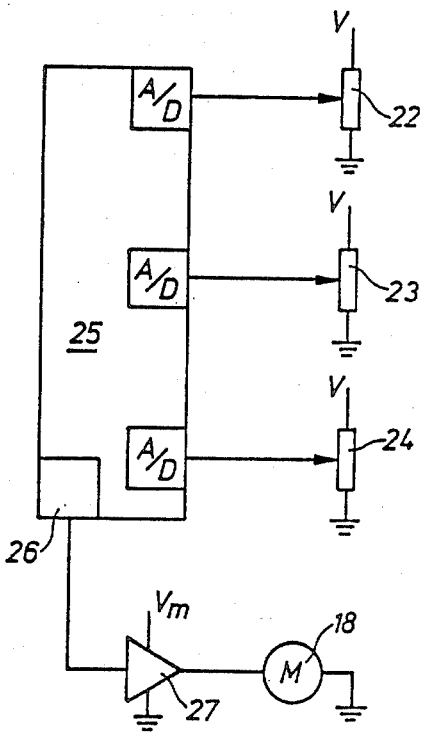

An electronic embodiment of the arrangement is shown in FIG. 2. For the reason of completeness the speed of cloth control 22 is shown in the form of a potentiometer by which the feeding speed thus caun be adjusted separately. In a conventional way of electronic sewing machines there are also a stitch length control 23 and a motor speed control 24 in connection with a microcomputer 25. A control circuit 26 in supplies a control signal to a driving circuit 27 of the driving motor 18. A counting operation is carried out in the computer in accordance with the formula in the foregoing:

$$r \leqq v/s$$

where v is the speed value adjusted on the control 22. The sign $\leqq$ is added in order to show that the machine can be driven slower (by means of the speed control 24) than the maximum value admitted by the adjustments. If the adjustments are changed, the computer calculates a new value of r which is stored and serves as a reference for a highest value of the control signal supplied to the driving circuit, there controlling a current to the motor corresponding to an equivalent value of r. Of course, calculating circuits for these operations may also be disposed in machines lacking the microcomputer.

The speed of cloth control has the highest adjustable value which in case of a large stitch length limits the r.p.m. This restriction protects the included electronic feeding components against overload and has therefore enabled the use of such components.

I claim:

1. In a speed control arrangement for a sewing machine having a motor, a control for setting stitch length (s) and controllable means for controlling the r.p.m. of said motor, the improvement wherein the arrangement comprises separate control means for setting a feeding speed (v) of cloth on the stitch plate of the sewing machine, said controllable means comprising means responsive to the stitch length (s) and the feeding speed (v) for limiting the r.p.m. (r) of the motor in accordance with the formula:

$$r > v/s$$

said controllable means comprising calculating means for determining a maximum current value for the r.p.m. control of said motor in accordance with said formula and means inhibiting the exceeding of said maximum current value.

2. The arrangement of claim 1, wherein the calculating means comprises part of a microcomputer in the sewing machine.

3. The arrangement of claim 1, wherein the control for cloth feeding speed comprises a manually adjustable knob or the like on the machine.

4. The arrangement of claim 2, wherein the microcomputer has a memory for storing seams which can be sewn by the machine, said memory storing codes corresponding to the stitch length adjustments of the stored seams, said microcomputer comprising means responsive to said codes for limiting the r.p.m. and thus for completing the calculation of r.p.m. of the motor for sewing these seams.

* * * * *